US011162262B2

(12) United States Patent
Poutanen

(10) Patent No.: US 11,162,262 B2
(45) Date of Patent: Nov. 2, 2021

(54) CUSTOMIZED WOODY TRUSSED JOIST

(71) Applicant: Tuomo Poutanen, Helsinki (FI)

(72) Inventor: Tuomo Poutanen, Helsinki (FI)

( * ) Notice: Subject to any disclaimer, the term of this patent is extended or adjusted under 35 U.S.C. 154(b) by 0 days.

(21) Appl. No.: 16/148,524

(22) Filed: Oct. 1, 2018

(65) Prior Publication Data

US 2020/0102746 A1 Apr. 2, 2020

(51) Int. Cl.
*E04C 3/12* (2006.01)
*E04C 3/18* (2006.01)

(52) U.S. Cl.
CPC ..... *E04C 3/18* (2013.01)

(58) Field of Classification Search
CPC ..... E04C 3/18; E04C 3/02; E04C 3/12; E04C 3/122; E04C 3/125; E04C 3/16; E04C 3/14; E04C 3/06
USPC ..... 52/837, 690, 693, 694, 695
See application file for complete search history.

(56) References Cited

U.S. PATENT DOCUMENTS 114,039 A * 4/1871 Pratt ..... E04C 3/292 52/693
184,522 A * 11/1876 Hammond ..... E04C 3/292 52/693
1,419,274 A * 6/1922 Lachman ..... E04C 3/08 52/693
2,444,133 A * 6/1948 Groat ..... E04B 2/14 52/22
2,780,842 A * 2/1957 Hess ..... E04C 3/16 52/693
3,452,502 A * 7/1969 Price ..... E04C 3/16 52/693
3,507,524 A * 4/1970 Steidle-Sailer ..... B27F 1/00 403/219
3,702,050 A * 11/1972 Price ..... E04C 3/16 52/693
3,857,218 A * 12/1974 Gilb ..... E04C 3/292 52/694
3,991,535 A * 11/1976 Keller ..... E04C 3/14 52/642
4,031,686 A * 6/1977 Sanford ..... E04C 3/292 52/693
4,077,176 A 3/1978 Bauer
(Continued)

FOREIGN PATENT DOCUMENTS

WO WO-2017/095798 6/2017

OTHER PUBLICATIONS

International Search Report dated Feb. 14, 2020 in International Application No. PCT/IB2019/001073.
(Continued)

*Primary Examiner* — Kyle J. Walraed-Sullivan
(74) *Attorney, Agent, or Firm* — B. Aaron Schulman, Esq.; Stites & Harbison, PLLC

(57) ABSTRACT

A trussed joist (such as shown in FIGS. 1, 2, and 3) is provided which includes an upper chord and a lower chord connected to each other by descending and ascending diagonals making triangular or trapezoid openings across the joist. The joist is supported at lower chord not matching the truss node point or supported at the upper chord whereby the joist is unworkable. At least one reinforcing is fixed at the faces of the chords by dowel fasteners. The reinforcing element overlaps at least one truss node point.

14 Claims, 3 Drawing Sheets

(56) References Cited

U.S. PATENT DOCUMENTS 4,104,843 A * 8/1978 Gilb ..... E04B 1/2612 52/693
4,630,424 A * 12/1986 Eberle ..... E04C 3/16 52/691
4,665,677 A * 5/1987 Palacio ..... E04C 3/292 52/693
5,560,177 A * 10/1996 Brightwell ..... E04C 3/16 52/690
5,592,800 A * 1/1997 Koo ..... E04C 3/292 52/692
5,664,393 A * 9/1997 Veilleux ..... E04C 3/16 52/650.1
5,867,962 A * 2/1999 Scott ..... E04C 3/292 52/696
5,867,963 A * 2/1999 Hershey ..... E04C 3/16 52/650.2
7,185,471 B2 * 3/2007 Schmerber ..... E04C 3/17 156/331.7
9,163,404 B2 * 10/2015 Vanker ..... E04C 3/08
2002/0007611 A1 * 1/2002 Sanford ..... E04C 3/16 52/694
2002/0040560 A1 * 4/2002 Kent ..... E04C 3/16 52/633
2002/0046534 A1 * 4/2002 Heinly ..... E04C 3/02 52/693
2002/0116892 A1 * 8/2002 Baranian ..... E04C 3/08 52/693
2002/0148192 A1 * 10/2002 Veilleux ..... E04C 3/16 52/841
2002/0148193 A1 * 10/2002 Veilleux ..... E04C 3/16 52/847
2003/0061780 A1 * 4/2003 Masterson ..... E04C 3/08 52/702
2008/0092988 A1 * 4/2008 Poutanen ..... B27F 1/16 144/347
2008/0250747 A1 * 10/2008 Johnson ..... E04C 3/16 52/693
2009/0094930 A1 * 4/2009 Schwoerer ..... E04C 3/16 52/693
2010/0263319 A1 * 10/2010 Lemyre ..... E04C 3/14 52/693
2013/0312361 A1 * 11/2013 Robinson ..... E04C 3/02 52/690
2015/0267407 A1 * 9/2015 Sirowatka ..... E04C 3/16 52/690
2015/0315786 A1 * 11/2015 Callahan ..... F21S 8/043 52/652.1
2016/0097196 A1 * 4/2016 Miller ..... E04B 9/06 52/483.1
2017/0016229 A1 * 1/2017 Cossette ..... E04C 3/16
2017/0058525 A1 * 3/2017 Hercus ..... E04C 3/16
2017/0234011 A1 * 8/2017 Poutanen ..... E04C 3/16 52/693

OTHER PUBLICATIONS

Written Opinion dated Feb. 14, 2020 in International Application No. PCT/IB2019/001073.
International Preliminary Report on Patentability for PCT/IB2019/001073 dated Apr. 15, 2021.

* cited by examiner

CUSTOMIZED WOODY TRUSSED JOIST

FIELD AND OVERVIEW OF THE INVENTION

The joist has, at least in its one end, an upper chord and a lower chord of woody material like sawn wood, glue lam, LVL, LSL, PSL, OSB, CLT, MDF, plywood etc. The chords are connected by a web structure of consecutive ascending and descending elongated diagonals which hit a chord about in same point, i.e. node point. The diagonals are normally also of woody material but sometimes of metal normally making similar triangular or trapezoid openings across the joist. The web structure may also include a few verticals i.e. elongated bars perpendicular to the chords, normally no verticals but less than four verticals per joist end, or panels like OSB-panels, normally only one panel per joist end. These joists include several deficiencies: weak web structure, shortening and notching the joist, cutting the joist into two or more working joists, supporting the joist at the lower chord elsewhere as on the truss node points, supporting the joist on the upper chord or between the chords. The disclosed invention overcomes all these shortcomings.

BACKGROUND OF THE INVENTION

Several embodiments are disclosed in the field of the invention like U.S. Pat. No. 5,560,177, US2002148193 and CA2198838. However, these joists can neither be notched nor supported from elsewhere as on the lower chord at a node point or on area with a panel between the chords. These solutions must be carried out in the factory and such joists cannot be cut into two or more functioning joists. The trussed joists are usually supported on the lower chord, but they can be supported above, too when special hangers of metal like WO2017095798 are used. They are expensive and prone to rusting, thermal bridges and condense. These hangers include a play making creak, increase the joist deflection and by no means increase the strength of the joist. The disclosed invention does not have these shortcomings.

SUMMARY OF THE INVENTION

The joist has two ends, the first end and the second end. The invention is primarily directed to the customized first end, but the disclosed embodiments are applicable between ends, too.

The invention is comprised of reinforcing elements which are fixed at the side faces of the chords using dowel fasteners like nails, screws and/or adhesive or fixed in the notches routed in the chords. These notches are deep either full or at least 67% of full chord depth.

If mechanical fasteners are used to fix the reinforcing elements the fixing takes place after the joist manufacture normally at a lumber yard or at a building site and if fixed using adhesive, fixed in junction of the joist manufacture at the factory or sometimes at a lumber yard.

The reinforcing elements are usually woody material like sawn wood, OSB, MDF, plywood, LVL, LSL, CLT or glue lam. The OSB4 standard panel is suited especially well for the purpose. The reinforcing element can also be plastic, metal, cast material or their combination, glued, welded or assembled otherwise. The reinforcing elements normally are sheet-like, from their outside measures rectangular, trapezoid, parallelogram, half parallelogram, triangular and/or Z letter-shaped where there is usually a nose which is the protrusion in the reinforcing element or one edge of the reinforcing element forms the nose. This nose reaches over the support. The reinforcing element can be also like a truss or a frame. If the reinforcing element is fixed at the factory to the joist, they are closed. If they are fixed at the site, they can also include holes and therefore are lighter are usually cheaper.

When the reinforcing element is fixed with dowel fasteners like nails or screws, the nose can be replaced, or the permanence can be increased with a metal sheet fixed between the reinforcing element and the chord. Alternatively, the metal sheet is replaced by a high strength woody panel like OSB-, plywood-, LVL or fiberboard-panel glued in the side faces of the chords. Further, the nose can be replaced, or the permanence can be increased by adapting the end of the chord with high-strength glued woody material like a billet made of plies, lamellas, strands or shavings of which the glue lines are mainly fitted vertically. LVL, LSL and OSB suit well for the purpose.

The length of the reinforcing element in the joist direction is at least about one half of the distance between adjacent truss node points up to about 1.5 times the distance between the node points. The reinforcing element overlaps at least one node point with sufficient fastener area at the lower or at the upper chord and in cases on high stresses overlaps at least two node points. This enables the cutting of the joist at any location and the reinforcing elements make the joist workable on any support alternative. If the reinforcing element is fixed besides the chords in a diagonal or a vertical, the number of fasteners is reduced, and the reinforcing element size is minimal. To make this possible, fillers like wood battens may be used between the reinforcing elements and the diagonals and verticals or the reinforcing element profile is fitted to diagonal/vertical contact.

In trussed joists connected with metal plates the reinforcing elements can be fixed directly in the diagonals without special measures.

There is at least one reinforcing element but usually two and sometimes even more elements per joist end. Normally, the reinforcing elements make a casing which is strong and easy to shape to different indentations and support alternatives because a filling like wood batten can be fixed using dowel fasteners into the casing to make joist overhang or support between chords.

When the reinforcing elements are fixed at a site, the joist can be economically manufactured at low season periods into stock as a long and/or standardized billet. Such billet can be cut at any location to shorten the joist or to make several working joists and supported arbitrarily. No earlier trussed joist has such high flexibility. In one embodiment, the billet is cut and customized for each special requirement in the factory or at the lumber yard which allows fastening the strengthening element by adhesive only and preferably by dowels and adhesive. In this alternative, the eventual proof loading is possible for the completed joist.

The reinforcing elements are usually cut from a wood panel. In each joist depth they are usually of uniform size or they are cut from a long panel of the beam depth. Their size depends on the location of the support about the node points. It is advantageous that cutting lines are drawn or partial cuttings like perforations are made about 300 mm apart to facilitate making the reinforcing elements even without special tools by folding along perforations.

In one embodiment, standardized trussed joists are made unfinished at least in one end comprising only the upper and lower chord to make chord tails. The web structure is mounted using the reinforcing elements explained here, case by case. This kind of a solution is economical because at the end of the joist there is no prefabricated web structure. To save the material it is advantageous that the chords tails are fitted to end in a separate section because usually only one chord must reach the support and the other chord may be shorter.

The first and/or second diagonal at the end of the trussed joist is critical for the strength. One application of the invention is that the reinforcing elements are used to strengthen the firmness of the diagonals at the end of the joist and sometimes between the ends or the reinforcing elements replace one diagonal or more.

If the joist is supported on the upper chord, it is essential that the reinforcing elements strengthen the support area of the chord so that, a considerable part of the support force, about at least a quarter, sometimes the whole support force moves through the reinforcing elements to the joist. In the chord support the shear and bending resistance of the chord are critical. When a part of the support force moves to the reinforcing element, it will lower the chord force and the shear and bending permanence is improved.

If the reinforcing elements have been glued to the chord notches, there are at least two reinforcing elements which may have several fingers of variable length per element. The elements form the compound structure and the critical shear resistance of the chord is increased when the shear resistance of the reinforcing material is higher than that of the chord material at least in the joist direction. The shear resistance is critical in the mid third of the chord cross section. Therefore, it is important the reinforcing elements fasten the upper and the lower third of the cross section. Thus, the reinforcing elements must be notched into the chords at least about 67% of the chord depth. This embodiment may have the upper chord support when the joist end is appropriately cut, and the reinforcing elements make noses reaching above the support and extending to the end of the chord. The total thickness of noses at the support edge is about 17-19 mm, the area at least about 500 mm2.

If the reinforcing elements are glued to the side faces of chords, there may be only one but usually two and that they are glued to both side face covering the full faces or almost full faces, more than about 90%. The compound thickness of the reinforcing elements at the edge of the support is at least about 17-19 mm, the area at least about 500 mm2.

If the reinforcing element has been mechanically fixed, the nose is usually made especially strong e.g. by making it thicker than the main reinforcing element and the nose usually reaches over the support from its lower surface only little i.e. the chord extends further. Normally, it is sufficient that the reinforcing element touches only the corner of the support but usually touches support no more than about 20-40 mm.

In an overhang chord support, it is important that the support force does not act at the end of the overhang as such support weakens the chord considerably due to long liver arm and high bending stress. The support force must locate as close to the first diagonal as possible to make a short liver arm. Therefore, it is advantageous to remove 1-3 mm from the lower surface of the chord either by horizontal or preferably inclined cut or to fix a filler above the support to make the overall support force closer to the first diagonal than half overhang length. Alternatively, the upper surface of the support is levelled accordingly. Normally, the chord—support contact surface is about 20 . . . 40 mm*chord width.

In the reinforcing element, there is usually a nose reaching over the support so that sufficient resistance is obtained. The nose can be replaced, or the firmness can be still increased when, at least one about 0.5-1.5 mm thick metal sheet is placed between the reinforcing element and the chord. The doweled fasteners of the reinforcing elements penetrate the metal sheet, too. This metal sheet is advantageously turned at least from its top over the chord about 10-30 mm but usually turned at least partly under the chord, too. This kind of a metal sheet can reach down to the lower chord in which case it as such is the reinforcing element meant by this invention. High strength is obtained when the reinforcing elements at opposite sides of the truss are connected to make full or half ring, e.g., by overlapping the elements above or under the chords and by nailing the elements together.

The invention is suited especially well for a metal web trussed joist in accordance with WO99/18304 and a trussed joist with punched metal connectors in accordance with U.S. Pat. No. 55,601,770. These joists can be supported on the lower surface of lower chord only. These joists can be supported on the upper chord and between the chords when two reinforcing elements are deeply notched in the chords at least 67% or glued at the faces of the chords and glued at a factory. Alternatively, the reinforcing elements are fastened mechanically and fastened at the site at the chord tails.

If the reinforcing elements are fixed at factory, glue is normally used. Alternatively, soft nails or screws made e.g. of aluminum, plastics or wood can be used to facilitate use of normal timber cutting tools.

The reinforcing elements can be used also for the lengthening of the joist when the support forces are small. One embodiment is that the secondary joist is supported on the side of one or more primary joists on the lower chords of the primary joists. This kind of a solution will be especially advantageous when the primary joist consists of several parallel joist side by side because the reinforcing elements can be extended over all the lower chords in which case the torsional stresses of the primary joists are avoided.

If the joist is subjected to fire resistance, the reinforcing elements are covered with appropriate paint, varnish, gypsum to improve the fire performance or the fire performance is obtained using other means.

DETAILED DESCRIPTION OF THE EXEMPLARY EMBODIMENTS

Figure 1:
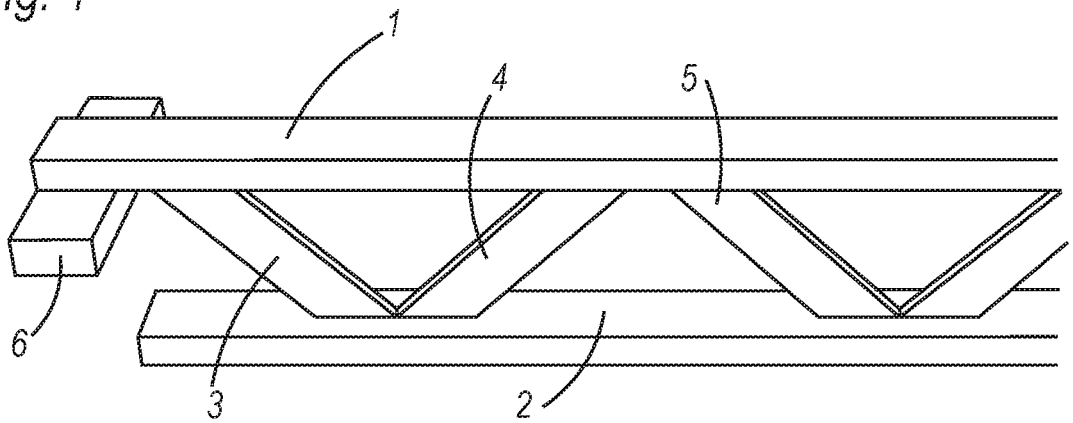
FIG. 1 represents an axonometric view of a glued trussed joist; the reinforcing elements are suitable for shortening of this joist with arbitrary support and joist end arrangement.

FIG. 1 shows a glued trussed joist which has upper chord 1 lower chord 2, diagonals 3, 4, 5 and support 6. The diagonals can be connected to the chord also in other way. This kind of a glued joist is workable as such without reinforcing elements supported on the upper chord if the support joint is appropriately made and on the lower chord, too, when the joist is turned. Such joists can be made to stock and using the reinforcing elements of the invention, the joist can be shortened and can be arbitrarily notched and can be further supported either on the upper chord, on the lower chord or on between. At least one diagonal at the joist end e.g. diagonal 3 may lack to reduce costs, ease cutting and facilitate indentation and this diagonal may be replaced with reinforcing elements.

Figure 2:
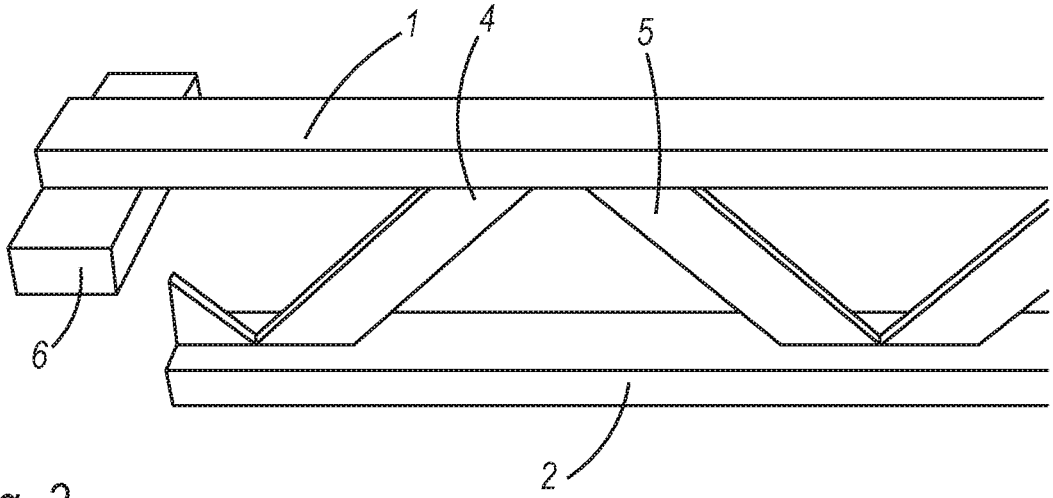
FIG. 2 represents a joist according to FIG. 1 which is cut, and the support is changed, the reinforcing elements have not been fixed in a joist.

FIG. 2 presents the joist of FIG. 1 which is arbitrarily cut and support 6 is in new location which can be anywhere. The cut joist is not usually structurally workable but becomes workable with the help of reinforcing elements.

Figure 3:
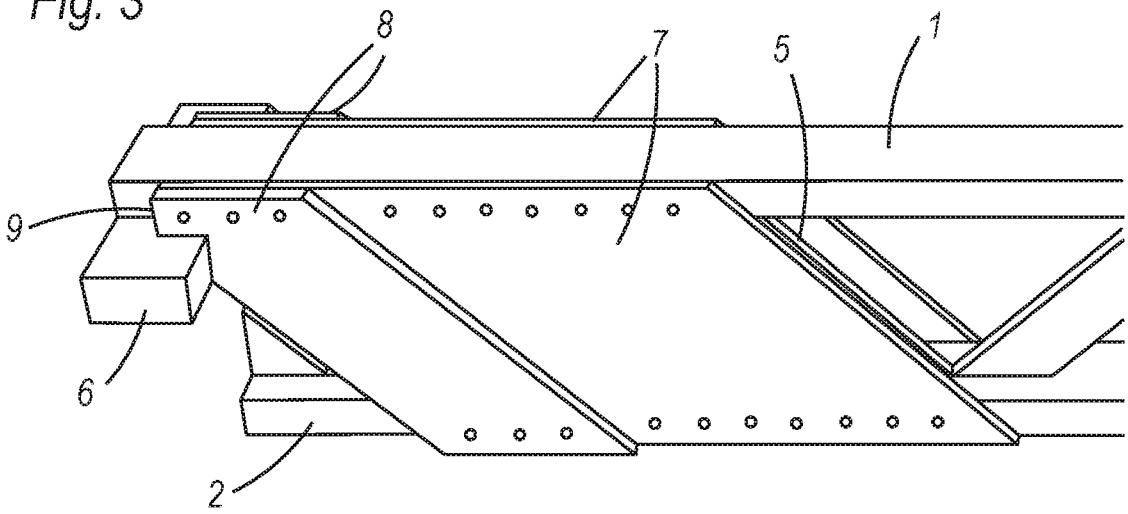
FIG. 3 represents a joist according to FIG. 2 with the reinforcing elements fixed.

FIG. 3 presents a joist of FIG. 2 to which the reinforcing elements 7 and 8 of wood panel have been attached at the end of the joist by side of the support either with support contact or minimal gap of construction works. It is usually sufficient to have only one reinforcing element pair either 7 or 8. In this case there are two reinforcing element pairs due to high stresses or due to thin panels. The elements are fastened in the chords by dowel fasteners like nails or screws. It is essential that the reinforcing elements have noses 9 which reach over the support 6 and through which an essential part of the support force is transferred to the reinforcing elements and still to the joist. Reinforcing element 8 is smaller and its main purpose is to increase the permanence of the nose 9. This element may be horizontal with depth about twice the chord depth or glued to the element 7 at the nose area when it is small even as little as about 20.000 $mm^2$. These reinforcing elements are parallelogram shaped and they are notched in this case by the support to accomplish the nose, but the notching is not usually needed in which case the reinforcing elements contact only on the corner of the support. This kind of a nose is efficient, its processing to the panel is simple and the material loss minimal. The Chord usually reaches over the support as an overhang of 50-100 mm. The reinforcing element reaches over the support of the same amount if it has been fixed with the glue but usually only 20-40 mm or normally hit only the support corner if it has been mechanically fastened. It is essential that the reinforcing element reaches on at least one truss node with sufficient nailing area per node with the overall fastener force of at least about 1.25 times the support force and in case of big forces over two truss nodes on either upper or lower chord preferably one on the lower chord and the other one on the upper chord. The number of fasteners is theoretically case-specific. Case specific calculations are not normally needed as the maximum nailing density at the support area and at the truss node point areas is normally sufficient. As the fastener cost is low, the nailing density may be the maximum at the whole element—chord area and this option is workable in all cases. In this embodiment, the lower chord may be shorter to facilitate a triangular space for the installations. This space is open from below thus the installations may be easily assembled. Such installation space and easy assembly is not possible in current joists.

Figure 4:
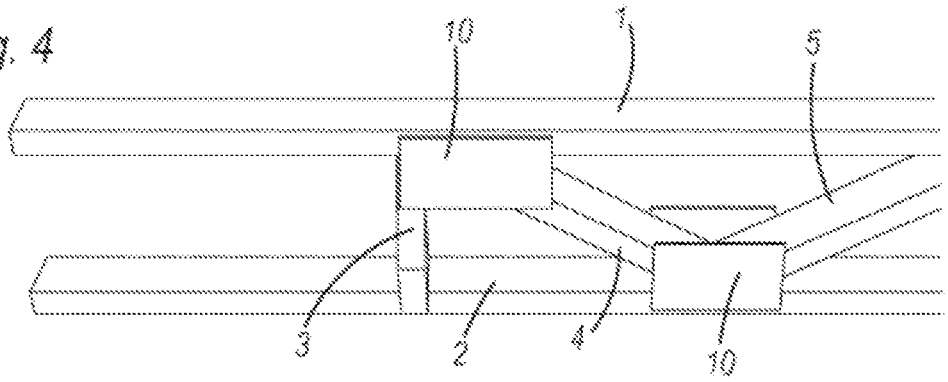
FIG. 4 represents the end of the trussed joist with metal connector plates, which can be shortened using the reinforcing elements, can be notched and can be supported in arbitrary ways.

FIG. 4 presents the trussed joist in which there are chords 1, 2 and diagonals 3, 4, 5 which have been connected to the chords with nail plates 10. At the end of the joist, the chords reach beyond the diagonals to make tails, normally about 300 to 700 mm. With the help of reinforcing elements, the joist becomes functioning, the end can be shortened, notched and the joist can be supported on the upper chord, on the lower chord or on between.

Figure 5:
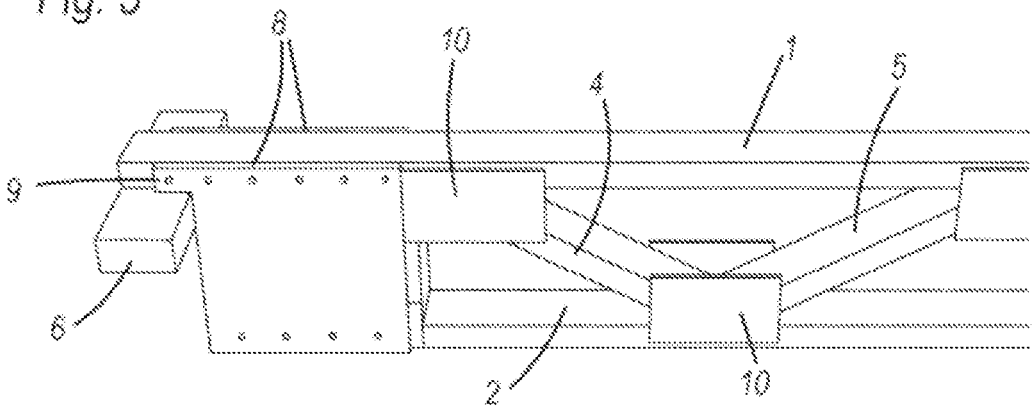
FIG. 5 represents a joist according to FIG. 4 with the reinforcing elements fixed.

FIG. 5 presents a joist of the FIG. 4 with fastened reinforcing elements 7, in this case wood panels like OSB panels and support 6. The reinforcing elements reach over the vertical and it is nailed to it in which case the fastening is effect and the number of fasteners small. One embodiment is that the upper chord is at least all the way to the first nail plate an especial high-strength wood, such as LVL, plywood or OSB in which glue lines are mainly vertical with grain direction fixed mainly in joist direction but at least about 10% fixed about vertically. Such upper chord has normally sufficient strength that the strengthening elements need not have noses.

Figure 6:
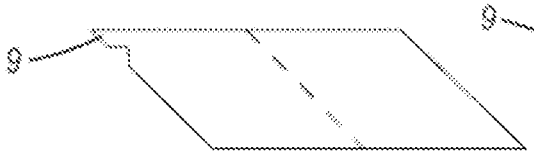
FIG. 6 represents a reinforcing element of parallelogram shape.

FIG. 6 presents a parallelogram shape reinforcing element with drawings or perforations in it which facilitate easy cutting.

Figure 7:
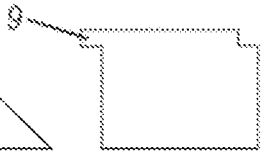
FIG. 7 represents a square reinforcing element.

FIG. 7 presents a quadratic reinforcing element which has been cut from a long panel.

Figure 8:
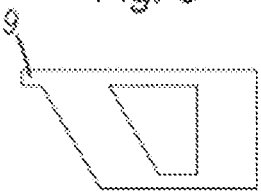
FIG. 8 represents a reinforcing element in which there is a hole.

FIG. 8 presents the reinforcing element in which there is a hole. It can be made among others from wood by gluing or by casting from woody mass and/or the element is made from metal by welding, punching or riveting etc. It is advantageous that at least the nose or at least its lower part is thicker than the main reinforcing element.

Figure 9:
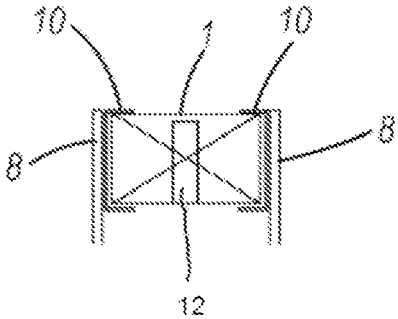
FIG. 9 represents metal sheets which are connected to the edge faces of the chord and strengthen the joint and can replace the nose of the reinforcing element.

FIG. 9 presents the cross section from chord 1, including reinforcing elements 8, metal sheets 10 in between nailed or screwed through the reinforcing elements to the chord, and chord routing or notch 12. The metal sheets are about 400-600 mm long and reach to the chord end or at least nearly to the end. These metal sheets prevent the chord from splitting and increase essentially its bending performance and shear resistance. The metal sheets can be variously shaped, for example they can be tubular or like C-profile. Instead of these metal sheets, the reinforcing can be carried out by gluing to the side faces of the chord high-strength material like woody panel like OSB-panel which reach to the end of the chord and are at least about 400-600 mm long.

Figure 10:
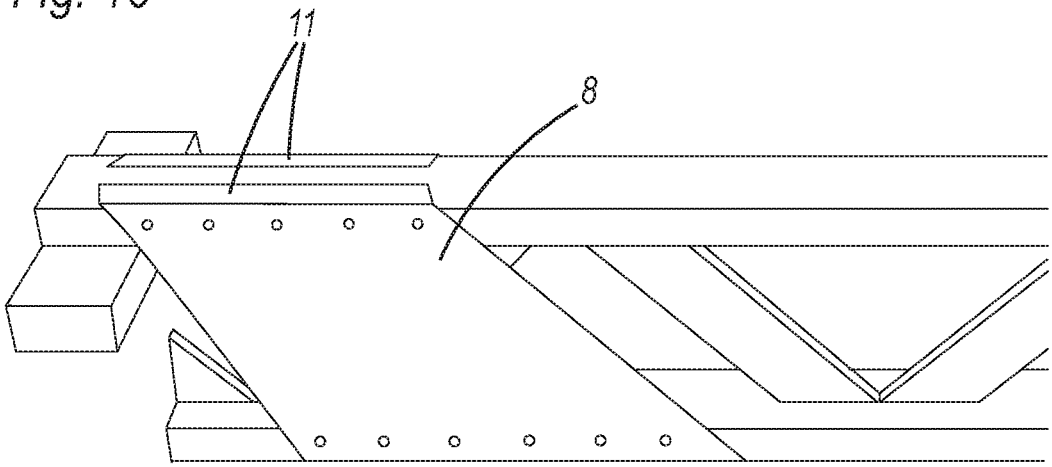
FIG. 10 represents the reinforcing element of metal.

FIG. 10 presents a reinforcing element of metal usually 0.5-1.5 mm thick. It is beneficial that the element has been turned over the upper chord 11. It is normally advantageous that in the reinforcing element there is a nose reaching over the support but in this case the nose is not always needed due to the element folding. The element is normally cut from a metal sheet but can be assembled from parts by welding, riveting, gluing etc. and can include holes. It is advantageous that the element comprises corrugations between the chords to increase it compression resistance and therefore the element is applicable at the lower chord support, too. The element is fastened in the side faces of the chords by dowel fasteners and advantageously in the upper chord folding, too. The element may include holes for the dowel fasteners to facilitate easy assembly.

What is claimed is:

1. A trussed joist comprising a first end and a second end, at least the first end comprising an upper chord and a lower chord of a wooden material connected to each other by elongated ascending and descending diagonals making generally triangular or trapezoidal transverse openings across the trussed joist and optionally having a plurality of verticals between the upper and lower chords, said upper and lower chords extending the elongated ascending and descending diagonals and verticals optionally to make tails;

wherein a structural form of the trussed joist is a truss at least at the first end and includes node points where one or two diagonals and optionally one vertical cross at a chord and the trussed joist at the first end has no reinforcements at the upper and lower chords or between the upper and lower chords that would allow a support elsewhere as at a node point of the trussed joist so that the support has no diagonal to make a diagonal-chord or diagonal-diagonal intersection;

wherein in the first end, the trussed joist does not have a node point and is supported at the first end;

wherein at least one reinforcing element is fixed by dowels, adhesive, or a combination thereof or two reinforcing elements fixed with adhesive, are fixed at side faces or notches of the upper and lower chords and optionally to at least one diagonal or vertical by a side of a support;

wherein the at least one reinforcing element overlaps at least one node point of the trussed joist;

wherein the at least one reinforcing element continuously extends between the upper and lower chords;

wherein the at least one reinforcing element faces the upper and lower chords at least in a support end at least two thirds or a notching depth is at least two third chord depth;

wherein an overall length of the at least one reinforcing element in a trussed joist direction is at least about one half node distance;

wherein a shear resistance of the at least one reinforcing element is higher than a shear resistance of the upper and lower chords in the trussed joist direction; and wherein the trussed joist is supported at an overhang chord, and wherein said overhang chord at least in a trussed joist end up to the first diagonal or vertical is a glued wooden material made of plies or shavings in which glue lines are fixed vertically.

2. The trussed joist according to claim 1 wherein the trussed joist is supported at the upper chord or between the upper and the lower chords wherein the at least one reinforcing element has a nose which is an extension of the at least one reinforcing element receiving at least a part of a support force reaching at least two thirds to the side faces or notches of the upper or lower chords at least in an edge of the support.

3. The trussed joist according to claim 2 wherein an overall thickness of the noses at an edge of the support is at least about 18 mm and an overall area of the noses is at least about 500 $mm^2$.

4. The trussed joist according to claim 2 wherein a metal sheet is fixed between the at least one reinforcing element and the one of upper and lower chords and the metal sheet is folded at least over the upper or the lower chord.

5. The trussed joist according to claim 2 wherein the at least one reinforcing element is a metal sheet fixed by dowel fasteners in side faces or notches of the upper and lower chords extending continuously between the upper and lower chords and the metal sheet is folded at least partly over either the upper chord or the lower chord, and the metal sheet is fastened using at least two dowel fasteners fixed into the chord.

6. The trussed joist according to claim 1 wherein at least one reinforcing element extends the trussed joist and the upper and the lower chords to make an overhang beyond the upper and lower chords, and the trussed joist is supported at the overhang.

7. The trussed joist according to claim 1 wherein a shape of the at least one reinforcing element remains uncut in a trimmed or cut trussed joint.

8. The trussed joist according to claim 1 wherein two reinforcing elements are fixed in the trussed joist one in one side of the trussed joist or fixed in a notches and another in another side of the trussed joist or fixed in a notch to make a void casing by a side of the support.

9. The trussed joist according to claim 2 with two reinforcing elements making a casing at an end of the trussed joist wherein the support is between the upper and lower chords and the at least one reinforcing element make noses above the support.

10. The trussed joist according to claim 2 wherein the at least one reinforcing element is wood panel fixed by dowel fasteners in side faces or notches of the upper and lower chords extending continuously between the upper and lower chords and the wood panel and is fastened using at least two dowel fasteners and the nose is in contact with the support receiving a part of the support force.

11. A trussed joist comprising a first end and a second end, at least the first end comprising an upper chord and a lower chord of a wooden material connected to each other by elongated ascending and descending diagonals making generally triangular or trapezoidal transverse openings across the trussed joist and optionally having a plurality of verticals between the upper and lower chords, said upper and lower chords extending the elongated ascending and descending diagonals and verticals optionally to make tails;

wherein a structural form of the trussed joist is a truss at least at the first end and includes node points where one or two diagonals and optionally one vertical cross at a chord and the trussed joist at the first end has no reinforcements at the upper and lower chords or between the upper and lower chords that would allow a support elsewhere as at a node point of the trussed joist so that the support has no diagonal to make a diagonal-chord or a diagonal-diagonal intersection;

wherein in the first end, the trussed joist does not have a node point and is supported at the first end;

wherein at least one reinforcing element is fixed by dowels, adhesive, or a combination thereof or two reinforcing elements fixed with adhesive, are fixed at side faces or notches of the upper and lower chords and optionally to at least one diagonal or vertical by a side of a support;

wherein the at least one reinforcing element overlaps at least one node point of the trussed joist;

wherein the at least one reinforcing element continuously extends between the upper and lower chords;

wherein the at least one reinforcing element faces the upper and lower chords at least in a support end at least two thirds or a notching depth is at least two third chord depth;

wherein an overall length of the at least one reinforcing element in a trussed joist direction is at least about one half node distance;

wherein a shear resistance of the at least one reinforcing element is higher than a shear resistance of the upper and lower chords in the trussed joist direction;

wherein, in addition to reinforcing provided by the at least one reinforcing element, reinforcing includes a nose which is an extension of at least the reinforcing receiving at least a part of a support force reaching at least two thirds to the side faces or notches of the upper or lower chords at least in an edge of the support, and wherein the at least one reinforcing element is a metal sheet fixed by dowel fasteners in side faces of the upper and lower chords and the metal sheet is folded at least partly over either the upper chord or the lower chord.

12. The trussed joist according to claim 11 wherein the at least one reinforcing element is a wood panel with a nose, and the nose is in contact with the support receiving a part of the support force.

13. A trussed joist comprising a first end and a second end, at least the first end comprising an upper chord and a lower chord of a wooden material connected to each other by elongated ascending and descending diagonals making generally triangular or trapezoidal transverse openings across the trussed joist and optionally having a plurality of verticals between the upper and lower chords, said upper and lower chords extending the elongated ascending and descending diagonals and verticals optionally to make tails;

wherein a structural form of the trussed joist is a truss at least at the first end and includes node points where one or two diagonals and optionally one vertical cross at a chord and the trussed joist at the first end has no reinforcements at the upper and lower chords or between the upper and lower chords that would allow a support elsewhere as at a node point of the trussed joist so that the support has no diagonal to make a diagonal-chord or diagonal-diagonal intersection;

wherein in the first end, the trussed joist does not have a node point and is supported at the first end;

wherein at least one reinforcing element is fixed by dowels, adhesive, or a combination thereof or two reinforcing elements fixed with adhesive, are fixed at side faces of the upper and lower chords and optionally to at least one diagonal or vertical by a side of a support;

wherein the at least one reinforcing element overlaps at least one node point of the trussed joist;

wherein the at least one reinforcing element continuously extends between the upper and lower chords;

wherein the at least one reinforcing element faces the upper and lower chords at least in a support end at least two thirds or a notching depth is at least two third chord depth;

wherein an overall length of the at least one reinforcing element in a trussed joist direction is at least about one half node distance;

wherein a shear resistance of the at least one reinforcing element is higher than a shear resistance of the upper and lower chords in the trussed joist direction;

wherein the trussed joist is supported at the upper chord or between the upper and the lower chords wherein the at least one reinforcing element has a nose which is an extension of the at least one reinforcing element receiving at least a part of a support force reaching at least two thirds to the side faces of the upper or lower chords at least in an edge of the support; and wherein a metal sheet is fixed between the at least one reinforcing element and the one of upper and lower chords and the metal sheet is folded at least over the upper or the lower chord.

14. A trussed joist comprising a first end and a second end, at least the first end comprising an upper chord and a lower chord of a wooden material connected to each other by elongated ascending and descending diagonals making generally triangular or trapezoidal transverse openings across the trussed joist and optionally having a plurality of verticals between the upper and lower chords, said upper and lower chords extending the elongated ascending and descending diagonals and verticals optionally to make tails;

wherein a structural form of the trussed joist is a truss at least at the first end and includes node points where one or two diagonals and optionally one vertical cross at a chord and the trussed joist at the first end has no reinforcements at the upper and lower chords or between the upper and lower chords that would allow a support elsewhere as at a node point of the trussed joist so that the support has no diagonal to make a diagonal-chord or diagonal-diagonal intersection;

wherein in the first end, the trussed joist does not have a node point and is supported at the first end;

wherein at least one reinforcing element is fixed by dowels, adhesive, or a combination thereof or two reinforcing elements fixed with adhesive, are fixed at side faces of the upper and lower chords and optionally to at least one diagonal or vertical by a side of a support;

wherein the at least one reinforcing element overlaps at least one node point of the trussed joist;

wherein the at least one reinforcing element continuously extends between the upper and lower chords;

wherein the at least one reinforcing element faces the upper and lower chords at least in a support end at least two thirds or a notching depth is at least two third chord depth;

wherein an overall length of the at least one reinforcing element in a trussed joist direction is at least about one half node distance;

wherein a shear resistance of the at least one reinforcing element is higher than a shear resistance of the upper and lower chords in the trussed joist direction;

wherein the trussed joist is supported at the upper chord or between the upper and the lower chords wherein the at least one reinforcing element has a nose which is an extension of the at least one reinforcing element receiving at least a part of a support force reaching at least two thirds to the side faces or notches of the upper or lower chords at least in an edge of the support; and wherein the at least one reinforcing element is a metal sheet fixed by dowel fasteners in side faces of the upper and lower chords extending continuously between the upper and lower chords and the metal sheet is folded at least partly over either the upper chord or the lower chord, and the metal sheet is fastened using at least two dowel fasteners fixed into the chord.

* * * * *